US007661279B2

(12) United States Patent
Huang et al.

(10) Patent No.: US 7,661,279 B2
(45) Date of Patent: Feb. 16, 2010

(54) LOCK ASSEMBLY

(75) Inventors: Hsing-Hui Huang, Taichung (TW); Hong-Sen Yan, Taichung (TW); Yi-Ming Lin, Taichung (TW)

(73) Assignee: Door & Window Hardware Co., Taichung (TW)

( * ) Notice: Subject to any disclaimer, the term of this patent is extended or adjusted under 35 U.S.C. 154(b) by 0 days.

(21) Appl. No.: 12/272,754

(22) Filed: Nov. 17, 2008

(65) Prior Publication Data

US 2009/0183539 A1 Jul. 23, 2009

Related U.S. Application Data

(63) Continuation-in-part of application No. 12/018,787, filed on Jan. 23, 2008, now abandoned.

(51) Int. Cl.
*E05B 59/00* (2006.01)
*E05B 63/14* (2006.01)

(52) U.S. Cl. ..... 70/107; 70/110; 70/134; 292/34

(58) Field of Classification Search ..... 70/106–111, 70/134, 150, 480–485, DIG. 6, DIG. 69; 292/33, 34, 36, 37, 40
See application file for complete search history.

(56) References Cited

U.S. PATENT DOCUMENTS 5,265,920 A 11/1993 Kaup et al.
5,267,457 A * 12/1993 Sorensen et al. ..... 70/130
5,301,525 A 4/1994 Doring
5,782,114 A 7/1998 Zeus et al.
5,819,562 A 10/1998 Christ
5,878,605 A 3/1999 Renz
6,131,966 A * 10/2000 Hensley et al. ..... 292/139
6,266,981 B1 7/2001 von Resch et al.
6,669,245 B2 12/2003 Ruano Aramburu et al.
6,810,699 B2 11/2004 Nagy
6,851,287 B1 * 2/2005 Yang et al. ..... 70/107
7,003,990 B2 2/2006 Iliuk
2002/0053227 A1 * 5/2002 Chiang et al. ..... 70/107
2002/0104339 A1 * 8/2002 Saner ..... 70/108
2003/0106350 A1 * 6/2003 Char et al. ..... 70/107
2003/0159478 A1 8/2003 Nagy

* cited by examiner

*Primary Examiner*—Lloyd A Gall
(74) *Attorney, Agent, or Firm*—patenttm.us

(57) ABSTRACT

A lock assembly has a body, a locking cylinder, a latching device, a linking device and a locking mechanism. The locking cylinder has a pushing lug. The linking device is connected to and driven by the latching device. The locking mechanism is driven by the pushing lug of the locking cylinder and has a bolt base, a pushing arm and a locking bolt. The bolt base is mounted slidably in the body and has an edge pushed by the pushing lug on the locking cylinder and a limiting tab. The locking bolt is slidably mounted on the bolt base and abuts with the limiting tab on the bolt base when the locking bolt retracts completely into or extends out from the body. The locking bolt has a blocking tab selectively blocks the linking device.

20 Claims, 10 Drawing Sheets

LOCK ASSEMBLY

This application is a continuation-in-part of the application Ser. No. 12/018,787, flied on Jan. 23, 2008, now abandoned.

BACKGROUND OF THE INVENTION

1. Field of the Invention

The present invention relates to a lock assembly, and more particularly to a lock assembly that can fit with auxiliary locks to provide a multi-locking-point effect and hold at a locked condition stably.

2. Description of Related Art

A conventional lock as U.S. Pat. No. 6,266,981, entitled to "Lock, in particular mortise lock for an exterior door" is provided, but the structure of the '981 Patent is complicate.

Additionally, another conventional lock is shown in U.S. Pat. No. 5,265,920, entitled to "Drive Rod Lock", but the '920 Patent also has a complicated structure.

To overcome the shortcomings, the present invention tends to provide a lock assembly to mitigate or obviate the aforementioned problems.

SUMMARY OF THE INVENTION

The main objective of the invention is to provide a lock assembly that has a simplified structure and can hold the lock assembly at a locked condition stably. The lock assembly has a body, a locking cylinder, a latching device, a linking device and a locking mechanism. The locking cylinder is mounted operationally on the body and has a pushing lug mounted on the locking cylinder. The latching device is mounted in the body and has a latch and a connecting device. The latch is mounted retractably in and extendably out from the body. The connecting device is connected to the latch to retract the latch into the body. The linking device is mounted in the body, is connected to and driven by the connecting device of the latching device. The locking mechanism is mounted in the body, is driven by the pushing lug of the locking cylinder and has a bolt base, a base spring, a pushing arm and a locking bolt. The bolt base is mounted slidably in the body at a position corresponding to the locking cylinder and has an edge and a limiting tab. The edge of the bolt base abuts with and is pushed by the pushing lug on the locking cylinder. The limiting tab is formed on the bolt base. The base spring is mounted in the body and has two ends connected respectively to the body and the bolt base. The pushing arm is pivotally connected to the body and selectively engaging and driven by the pushing lug of the locking cylinder. The locking bolt is slidably mounted on the bolt base, is connected to and pushed by the pushing arm to be retractable into and extendable out from the body. The locking bolt abuts with the limiting tab on the bolt base when the locking bolt retracts completely into or extends out from the body. The locking bolt has a blocking tab formed on the locking bolt to selectively abut and block the linking device.

Other objects, advantages and novel features of the invention will become more apparent from the following detailed description when taken in conjunction with the accompanying drawings.

DETAILED DESCRIPTION OF PREFERRED EMBODIMENT

Figure 1:
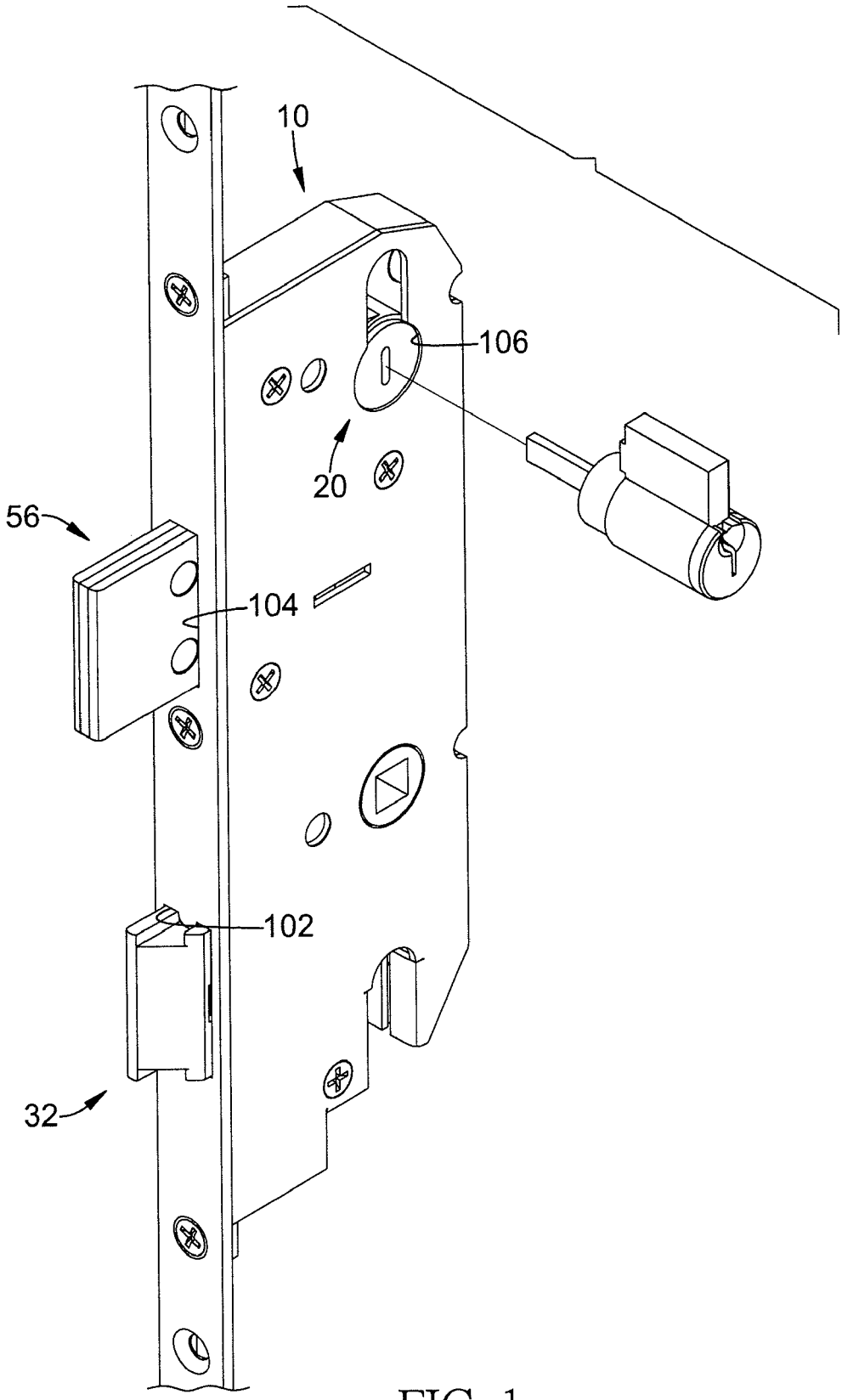
FIG. 1 is an exploded perspective view of a first embodiment of a lock assembly in accordance with the present invention.
Figure 2:
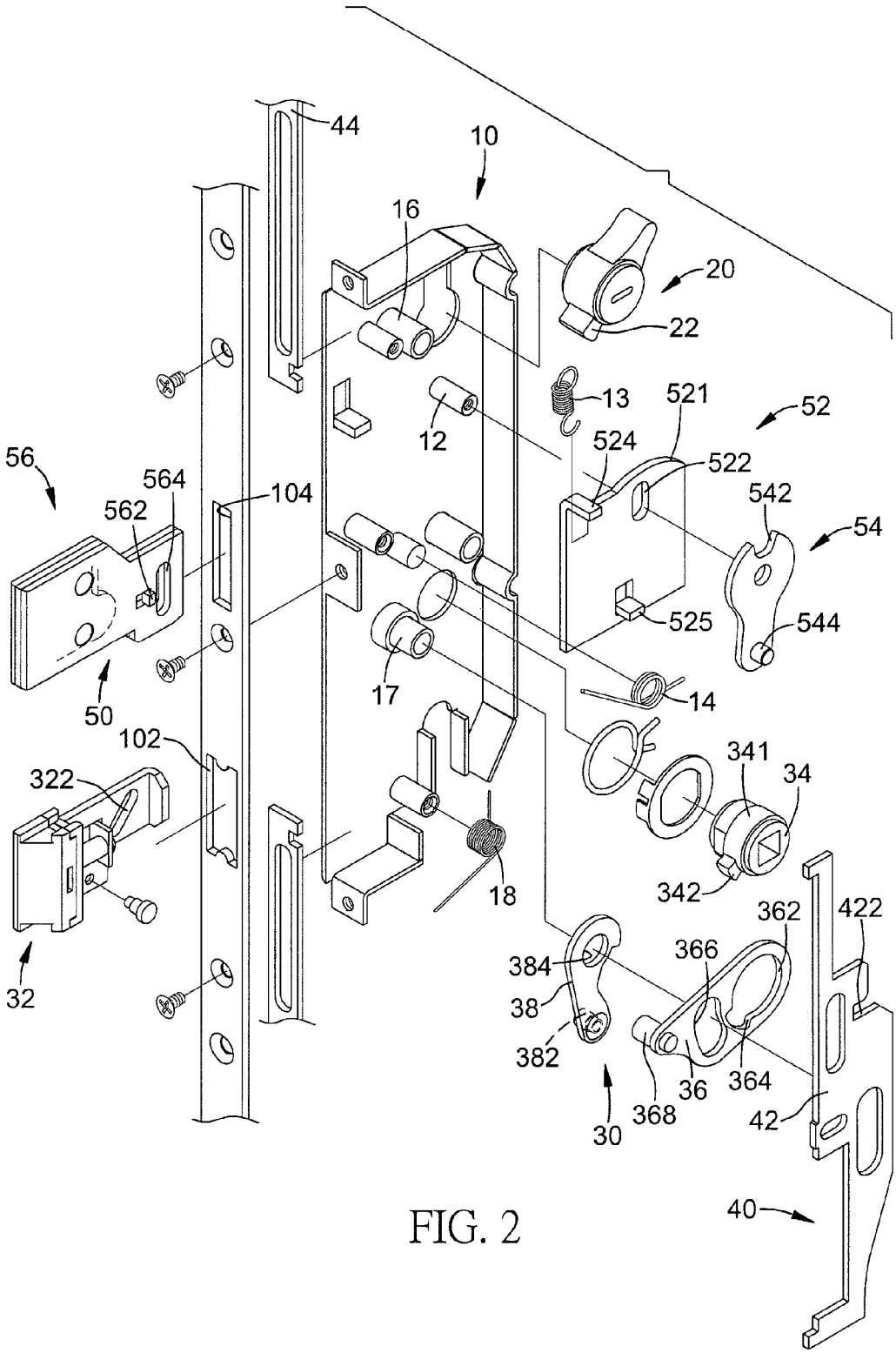
FIG. 2 is an exploded perspective view of the lock assembly in FIG. 1.
Figure 3:
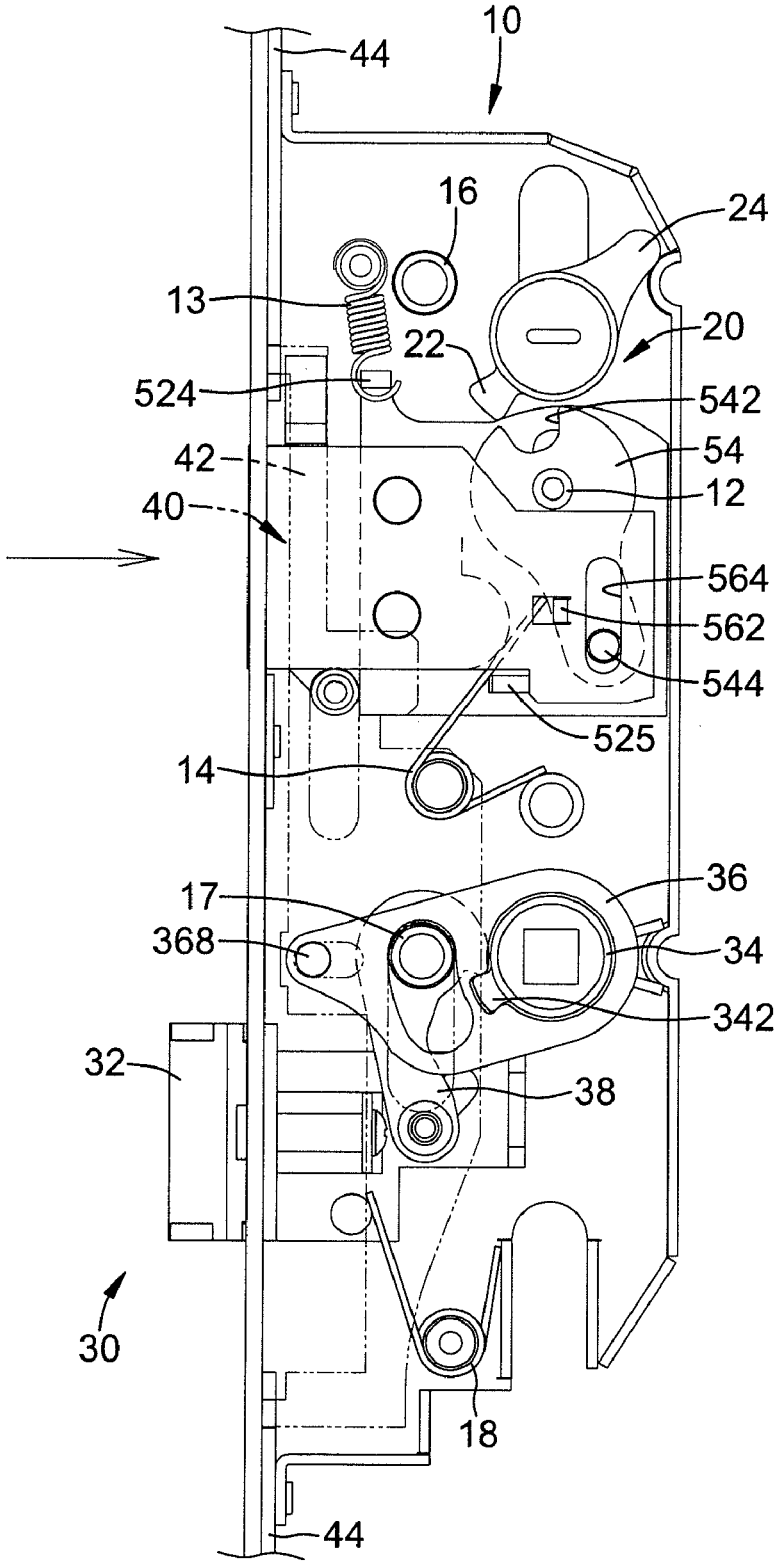
FIG. 3 is a side view of the lock assembly in FIG. 1 with a cover being removed.

With reference to FIGS. 1 to 3, a lock assembly in accordance with the present invention is connected to auxiliary locks to provide a multi-locking-points effect and comprises a body (10), a locking cylinder (20), a latching device (30), a linking device (40) and a locking mechanism (50). The body (10) is securely attached to a door, is hollow and may be implemented by a base and a cover. The body has a bottom, a latching opening (102), a bolt opening (104) and a cylinder hole (106) defined through the body (10). The latching opening (102) and the bolt opening (104) are defined in one side of the body (10).

Figure 8:
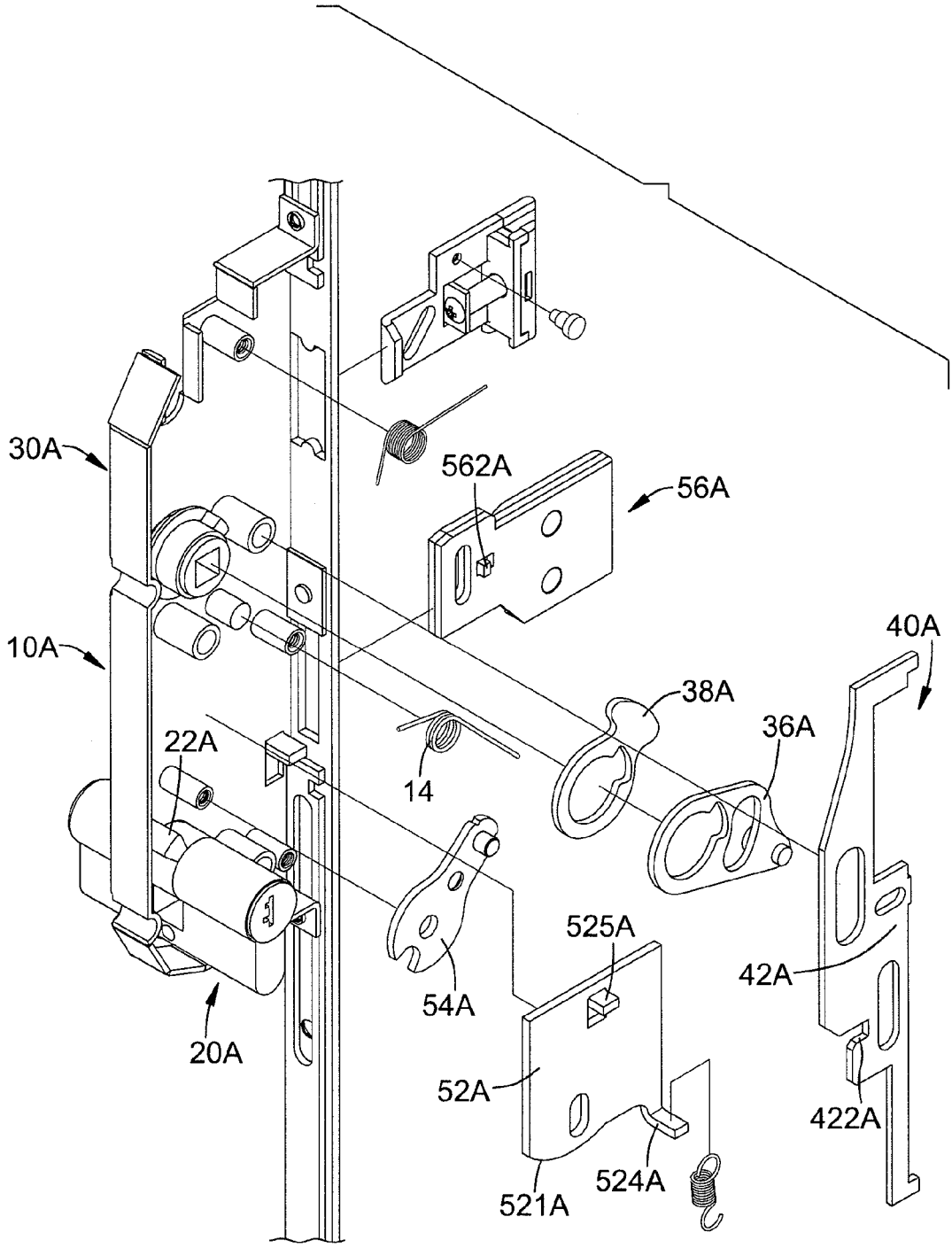
FIG. 8 is an exploded perspective view of a second embodiment of a lock assembly in accordance with the present invention.

The locking cylinder (20) is mounted operationally in the cylinder hole (106) in the body (10) and has a pushing lug (22) mounted on the locking cylinder (20). The locking cylinder (20,20A) may be in different types as shown in FIGS. 1, 2 and 8. In addition, the locking cylinder (20) may further have a stop (24) formed on the locking cylinder (20). The body (10) further has a stopping post (16) formed on the body (10) and selectively abutting the stop (24) on the locking cylinder (20) to limit the rotating range of the locking cylinder (20).

The latching device (30) is mounted in the body (10) and comprises a latch (32) and a connecting device. The latch (32) is mounted retractably in and extendably out from the latching opening (102) in the body (10). The connecting device is connected to the latch (32) to retract the latch (32) into the body (10) via the latch opening (102).

The connecting device of the latching device (30) comprises a driving cylinder (34), a driving panel (36) and a connecting arm (38).

The driving cylinder (34) rotatably mounted in the body (10) and is connected to a handle to allow a user to rotate the driving cylinder (34) by turning the handle. The driving cylinder (34) has an outer surface (341) and a driving lug (342) formed on and protruding from the outer surface (341) of the driving cylinder (34).

The driving panel (36) is mounted around the driving cylinder (34) and has a proximal end, a distal end, a mounting hole (362) and a connecting stub (368). The proximal end is mounted around the driving cylinder (34). The distal end is provided with a connecting stub (368) and is connected to the linking device (40). The mounting hole (362) is defined through the proximal end and is mounted around the driving cylinder (34). The mounting hole (362) has an inner surface and an engaging notch (364) defined in the inner surface and engaging the driving lug (342) on the driving cylinder (342). Accordingly, when the driving cylinder (34) is rotated, the driving panel (36) can rotate with the driving cylinder (34) with the engagement between the driving lug (342) and the engaging notch (364).

Figure 6:
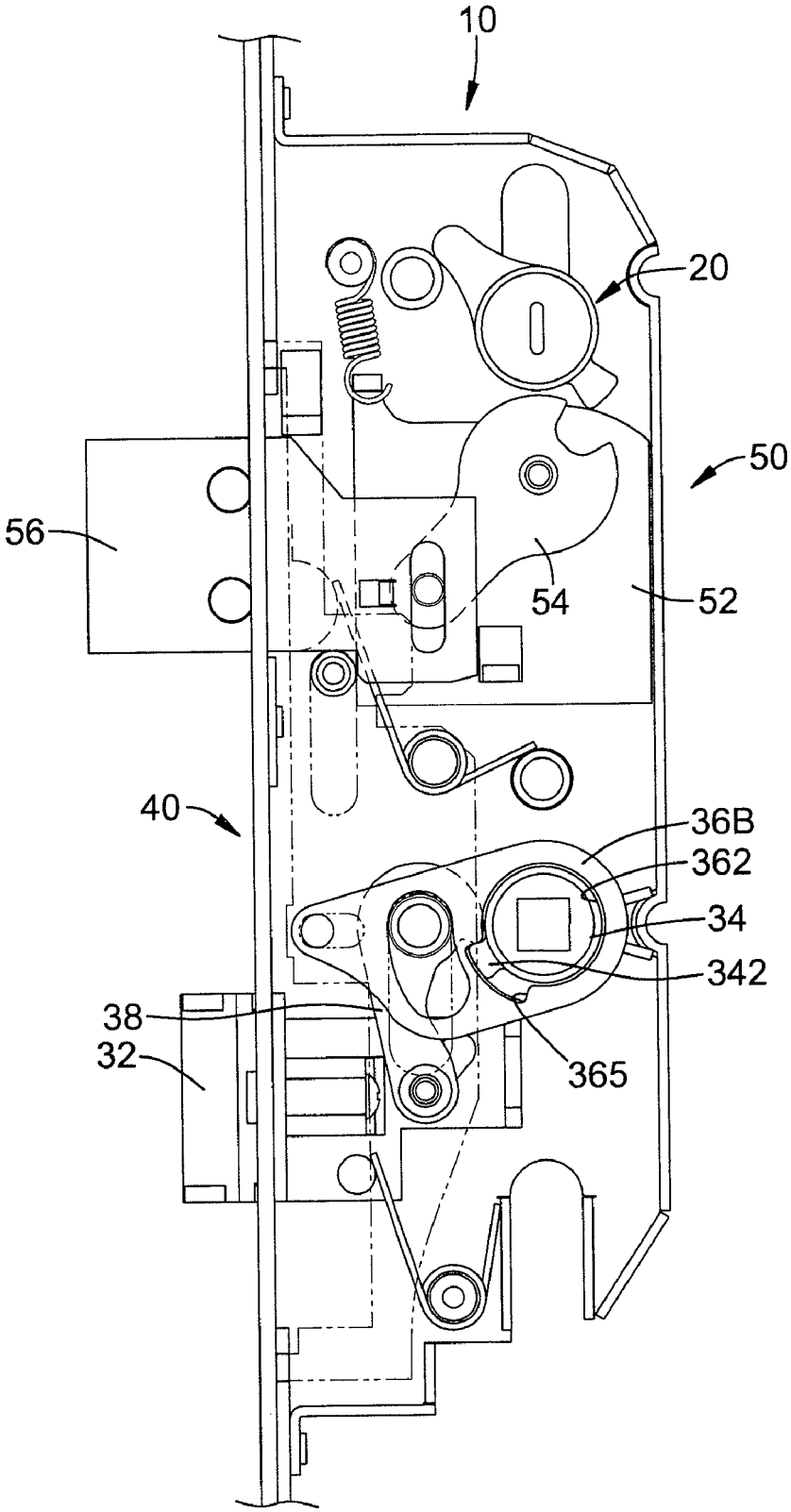
FIG. 6 is a side view of a lock assembly with an alternative embodiment of a driving panel of a latching device in accordance with the present invention.
Figure 7:
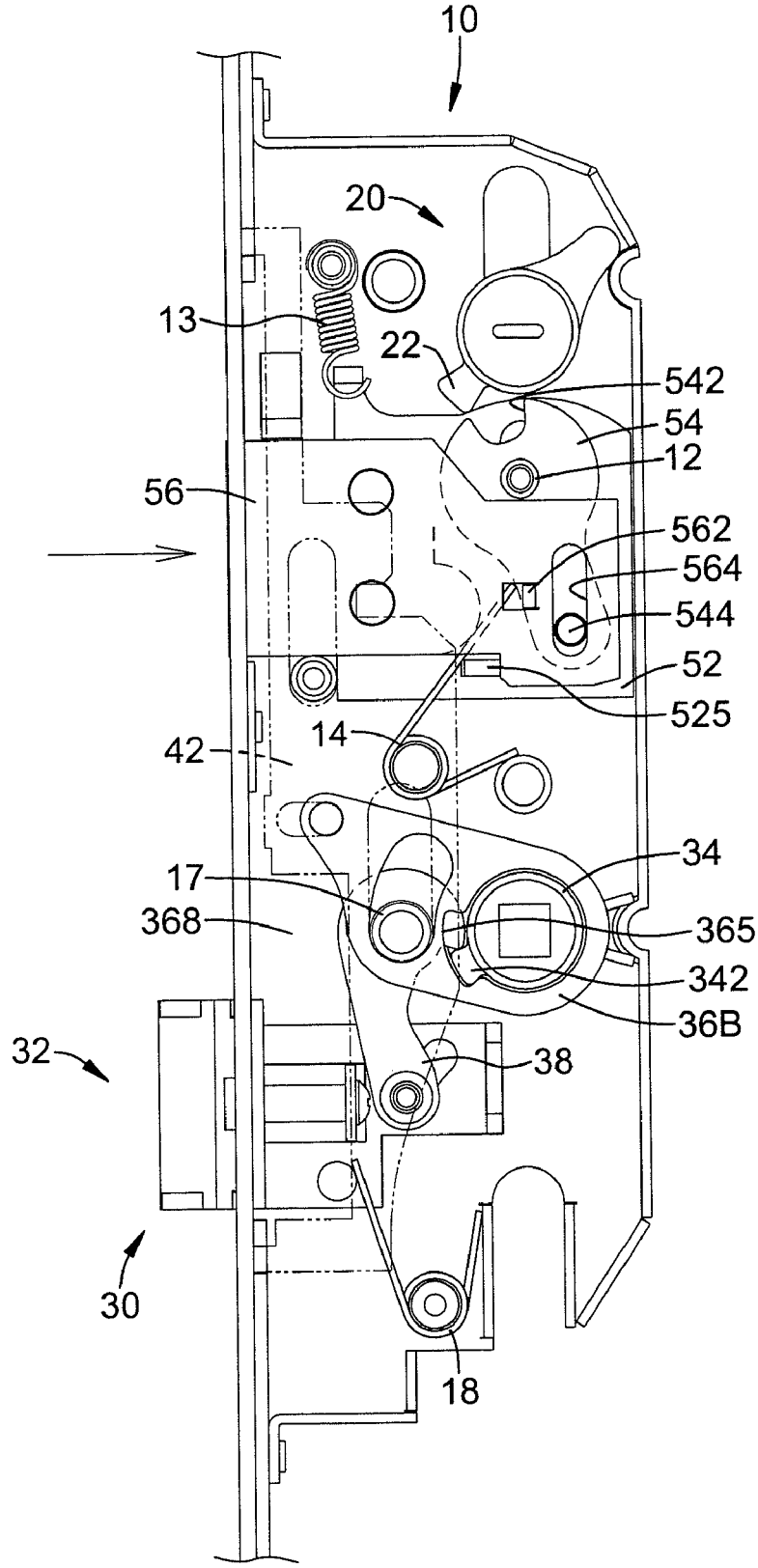
FIG. 7 is an operational side view of the lock assembly in FIG. 6.

In an alternative embodiment as shown in FIGS. 6 and 7, a curved engaging groove (365) is defined in the inner surface of the mounting hole (362) and slidably holds the driving lug (342) on the driving cylinder (34) inside the engaging groove (365). With the arrangement of the engaging groove (365), a relative rotation of the driving cylinder (34) relative to the driving panel (36B) is allowed to make the driving panel (36B) to drive different kinds of auxiliary locks to operate.

Figure 5:
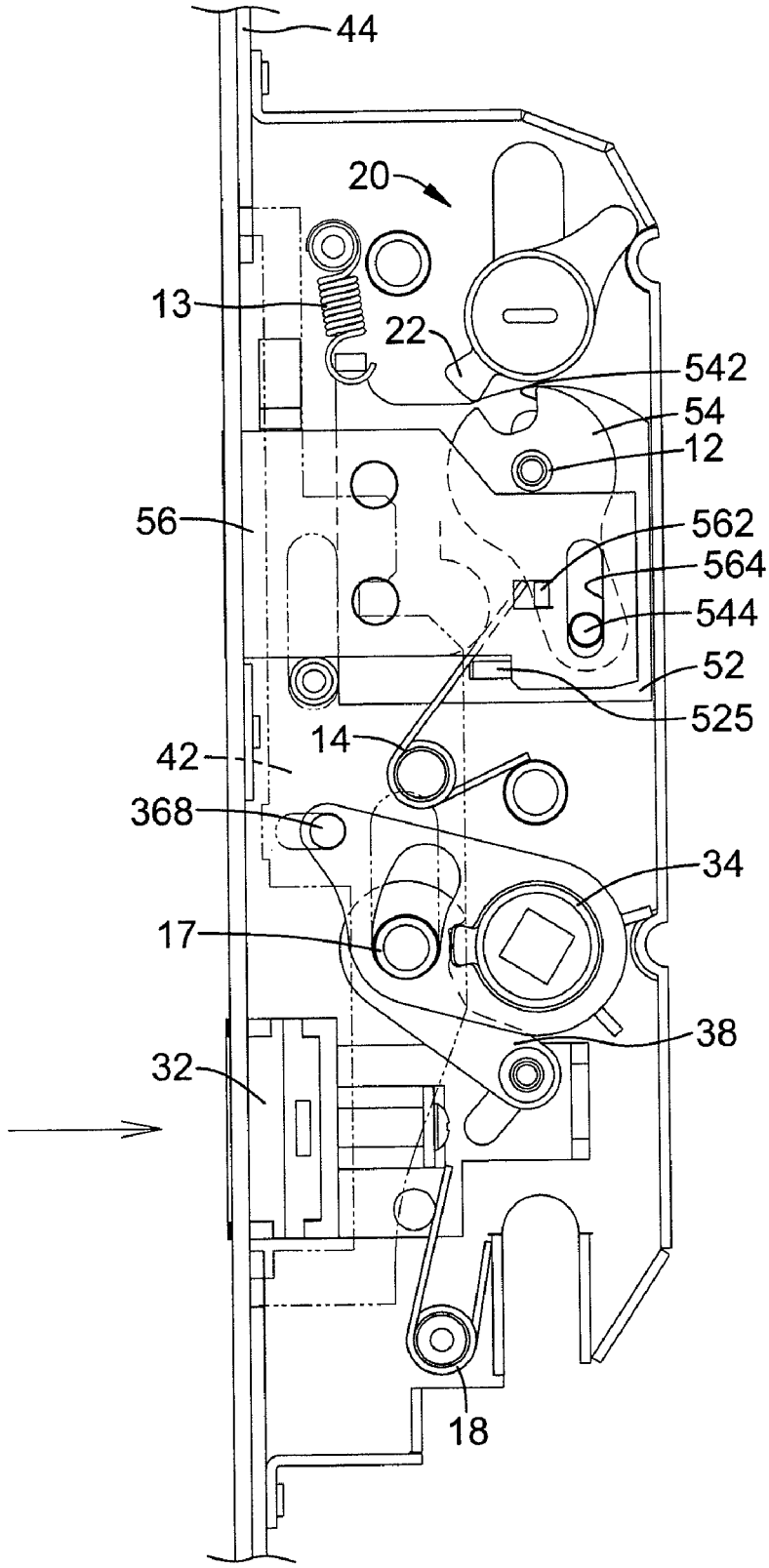
FIG. 5 is an operational side view of the lock assembly in FIG. 3 showing that the lock assembly is at an unlocked condition.

The connecting arm (38) is mounted pivotally in the body (10), is connected slidably to the driving panel (36) and the latch (32), abuts with the driving lug (342) on the driving cylinder (34) and has a proximal end and a distal end. The proximal end of the connecting arm (38) is pivotally attached to the body (10) and is slidably connected to the driving panel. The distal end of the connecting arm (38) is provided with a connection rod (382) and is connected slidably to the latch (32) To pivotally attach the proximal end of the connecting arm (38) to the body, the body has a pivotal rod (17) formed on and protruding from the body (10). The proximal end of the connecting arm (38) has a through hole (384) mounted rotatably around the pivotal rod (17) to allow the connecting arm (38) to pivot at the pivotal rod (17). In addition, the driving panel (36) further has a curved guiding slot (366) defined through the driving panel (36) and having a center at the driving cylinder (34) and slidably holding the pivotal rod (17) inside the guiding slot (366). The connection rod (382) on the distal end of the connecting arm (38) extends slidably in an inclined slot (322) defined in the latch (32). Accordingly, with reference to FIG. 5, when the driving cylinder (34) is rotated, the latch (32) can be retracted into the body (10) via the latch opening (102) with the transmission of the driving panel (36) and the connecting arm (38). Thus, a door with the lock assembly can be opened.

A latch spring (18) is mounted in the body (10) and has two ends abutting respectively with the body (10) and the latch (32) to provide a force to always extend the latch (32) out from the latch opening (102).

The linking device (40) is mounted in the body (10), is connected to and driven by the connecting device of the latching device (30) and is connected with two auxiliary locks. The linking device (40) comprises a linking panel (42) and two linking arms (44). The linking panel (42) is mounted slidably in the body (10) and is connected to the distal end of the driving panel (36) with the connecting stub (368). Accordingly, when the driving cylinder (34) is rotated and the driving panel (36) is pivoting, the linking panel (42) is moved upward or downward. The linking panel (42) has a top edge and a locking notch (422) defined in a side of the linking panel (42).

The linking arms (44) are connected to two ends of the linking panel (42) and are connected respectively to the auxiliary locks. When the linking panel (42) is moved, the linking arms (44) are also moved so as to unlock the auxiliary locks. The structure of an auxiliary lock and the way of unlocking the auxiliary way by the linking arms (44) may be conventional and not the subject matter of the present invention, so detail description about the auxiliary lock is omitted.

Figure 9:
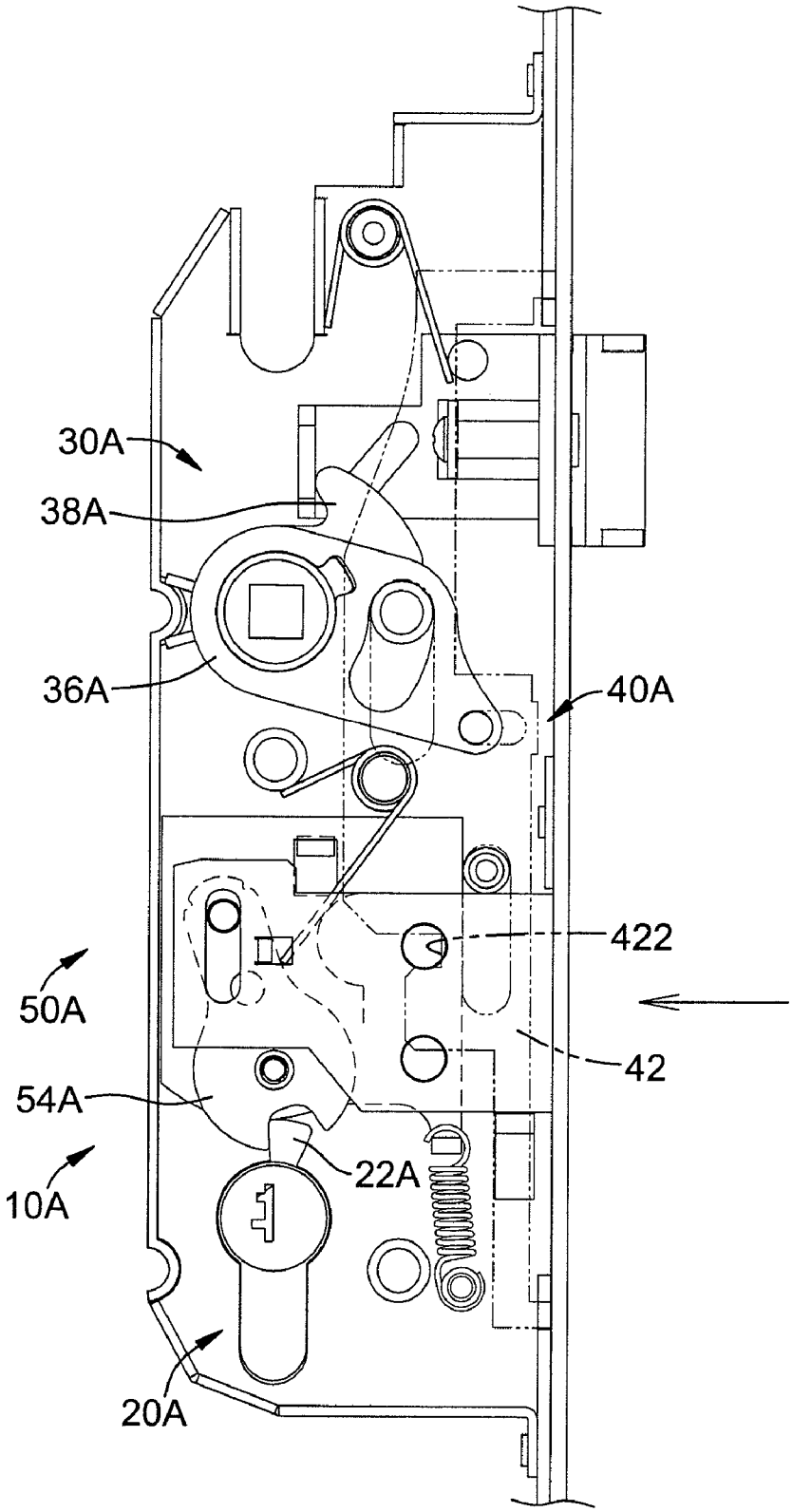
FIG. 9 is a side view of the lock assembly in FIG. 8 showing that the lock assembly is at an unlocked condition.

The locking mechanism (50) is mounted in the body (10) and is driven by the pushing lug (22) of the locking cylinder (20). In a first embodiment as shown in FIGS. 2 and 3, the locking cylinder (20) and the locking mechanism (50) are mounted near the top edge of the body (10) at a position above the latching device (30). In a second embodiment as shown in FIGS. 8 and 9, the locking cylinder (20A) and the locking mechanism (50A) are mounted near the bottom edge of the body (10A) at a position below the latching device (30A).

The locking mechanism (50) comprises a bolt base (52), a pushing arm (54) and a locking bolt (56).

The bolt base (52) is mounted slidably in the body (10) at a position corresponding to the locking cylinder (20). The bolt base (52) has an edge (521) abutting with the pushing lug (22) on the locking cylinder (20), and the edge (521) may be curved. In the first embodiment as shown in FIGS. 2 and 3, the edge (521) of the bolt base (52) abutting with the pushing lug (22) on the locking cylinder (20) is the top edge. In the second embodiment as shown in FIGS. 8 and 9, the edge (521A) of the bolt base (52A) abutting with the pushing lug (22A) on the locking cylinder (20A) is the bottom edge.

To slidably mount the bolt base (52) in the body (10), the bolt base (52) has a base slot (522) defined longitudinally through the bolt base (52). The body (10) further has a guiding rod (12) formed on and protruding from the body (10) and extending slidably into the base slot (522) in the bolt base (52). A base spring (13) is mounted in the body (10) and has two ends connected respectively to the body (10) and the bolt base (52) to provide a force to pull the bolt base (52) to an original position.

In addition, the bolt base (52) of the lock mechanism (50) further has a limiting tab (525) and a guiding tab (524). In the first embodiment as shown in FIGS. 2 and 3, the limiting tab (525) is formed on the bottom edge, and the guiding tab (524) is formed on the top edge and is connected to the base spring (13). In the second embodiment as shown in FIGS. 8 and 9, the limiting tab (525A) is formed on the top edge, and the guiding tab (524A) is formed on the bottom edge. A sliding space is defined between the limiting tab (525) and the guiding tab (524).

The pushing arm (54) is pivotally connected to the body (10) and selectively engages and is driven by the pushing lug (22) of the locking cylinder (20). In the preferred embodiment, the pushing arm (54) is attached rotatably to the guiding rod (12) on the body (10). The pushing arm (54) has a first end, a second end, a notch (542) and a pushing rod (544). The notch (542) is defined in the first end of the pushing arm (54) and selectively engages the pushing lug (22) on the locking cylinder (20). The pushing rod (544) is formed on and protrudes from the second end of the pushing arm (54).

The locking bolt (56) is slidably mounted on the bolt base (52) in the sliding space, is connected to and pushed by the pushing arm (54) to be retractable into and extendable out from the body (10) via the bolt opening (104). The locking bolt (56) may abut with the limiting tab (525) on the bolt base (52) when the locking bolt (56) retracts completely into extends out from the body (10). The locking bolt (56) has a blocking tab (562) formed on the locking bolt (56) to selectively abut and block the linking device (40). In a preferable embodiment, the locking bolt (56) may be an integral single piece or be implemented by multiple boards.

The locking bolt (56) further has a bolt slot (564) defined longitudinally through the locking bolt (56) and being parallel with the base slot (522) in the bolt base (52). The pushing rod (544) on the pushing arm (54) extends slidably into the bolt slot (564) in the locking bolt (56) to push the locking bolt (56) relative to the sliding space in the bolt base (52) when the pushing arm (54) being pivoted.

In addition, a bolt spring (14) is mounted in the body (10) and has two ends abutting respectively with the body (10) and the locking bolt (56).

Figure 4:
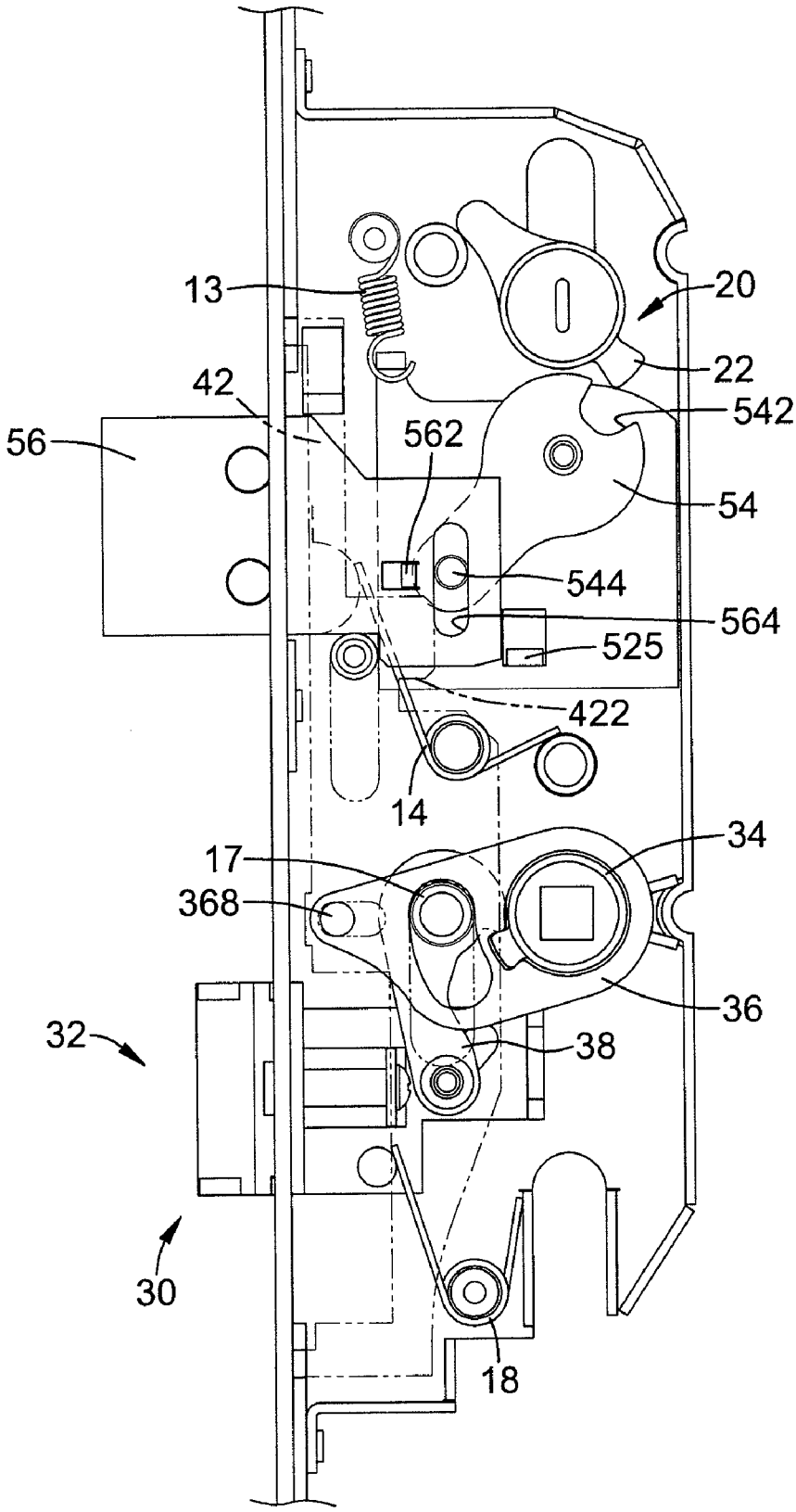
FIG. 4 is an operational side view of the lock assembly in FIG. 3 showing that the locking bolt is extended to make the lock assembly at a locked condition.

With reference to FIG. 3, in an unlocked condition of the lock assembly, the locking bolt (56) abuts with the limiting tab (525) on the bolt base (52). With further reference to FIG. 4, when the locking cylinder (20) is rotated with a specific key, the bolt base (52) is pushed to move downward by the pushing lug (22) on the locking cylinder (20). The limiting tab (525) will leave the position where abutting with the locking bolt (56). When the locking cylinder (20) is rotated, the pushing arm (54) will be pivoted relative to the body (10) by the engagement of the pushing lug (22) and the notch (542). Accordingly, the locking bolt (56) will be extended out from the body (10) via the bolt opening (104) by the pushing rod (544), such that the lock assembly is locked.

When the lock assembly is at a locked condition, the blocking tab (562) abuts with the top edge of the linking panel (42) or engages the locking notch (422) in the linking panel (42) to provide a blocking effect to the linking panel (42). Accordingly, the linking panel (42) is prevent from moving relative to the body (10), and the latching device (30) is kept from being operated.

Moreover, when the locking cylinder (20) is rotated and the pushing lug (22) disengages from the notch (542), the bolt base (52) is moved upward due to the curved travel of the pushing lug (22) and with the force provided by the base spring (13). The limiting tab (525) will move to a position where corresponding to the locking bolt (56). Consequently, the locking bolt (56) cannot be retracted into the body (10) due to the abutment of the limiting tab (525) even a huge force applied to the locking bolt (56). Therefore, the lock assembly will be kept at the locked condition stably.

To unlock the locking mechanism (50), the locking cylinder (20) is rotated in reverse, and the pushing arm (54) is pivoted and swings in reverse by the pushing lug (22) on the locking cylinder (20). The bolt base (52) is moved downward firstly, and the locking bolt is then retracted into the body (10) by the transmission of the pushing arm (54) to unlock the lock assembly as shown in FIG. 3.

Figure 10:
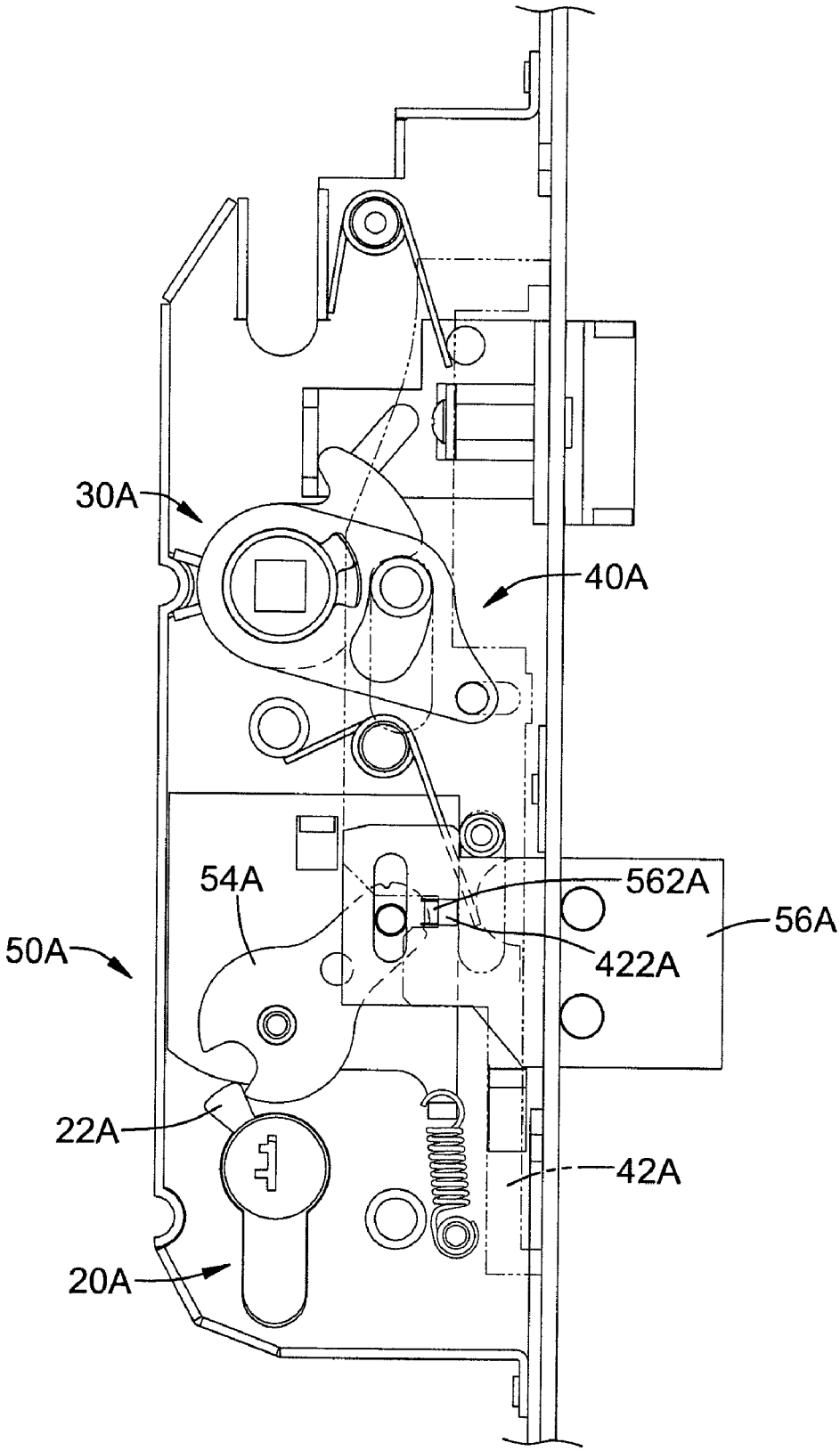
FIG. 10 is an operational side view of the lock assembly in FIG. 8 showing that the lock assembly is at a locked condition.

The operation of the second embodiment as shown in FIGS. 8 to 10 is similar to that of the first embodiment, but the moving direction of the second embodiment may be opposite to that of the first embodiment. The structures of the latching device (30A) including the driving panel (36) and the connecting arm (38A), the linking device (40A) and the locking mechanism (50A) including the bolt base (52A), the pushing arm (54A) and the locking bolt (56A) in the second embodiment may be same as those in the first embodiment, so further description is omitted. In addition, the locking notch (422A) in the linking panel engages the blocking tab (562A) on the locking bolt (56A) when the locking bolt (56A) extends from the body (10A) as shown in FIG. 10 to hold the linking panel (42A) at a locked position.

With such a lock assembly in accordance with the present invention, the structure of the lock assembly is simplified and is easily assembled and manufactured. With different arrangements of locations and directions of the devices, the lock assembly in accordance with the present invention can fit with different types of cylinder (20,20A) and auxiliary locks and is versatile in use.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A lock assembly comprising:

a body;

a locking cylinder mounted operationally on the body and having a pushing lug mounted on the locking cylinder;

a latching device mounted in the body and comprising a latch mounted retractably in and extendably out from the body; and a connecting device connected to the latch to retract the latch into the body;

a linking device mounted in the body, connected to and driven by the connecting device of the latching device; and a locking mechanism mounted in the body, driven by the pushing lug of the locking cylinder and comprising a bolt base mounted slidably in the body at a position corresponding to the locking cylinder and having an edge abutting with and pushed by the pushing lug on the locking cylinder; and a limiting tab formed on the bolt base;

a base spring mounted on the body and having two ends connected respectively to the body and the bolt base;

a pushing arm pivotally connected to the body and selectively engaging and driven by the pushing lug of the locking cylinder; and a locking bolt slidably mounted on the bolt base, connected to and pushed by the pushing arm to be retractable into and extendable out from the body, abutting with the limiting tab on the bolt base when the locking bolt retracts completely into or extends out from the body and having a blocking tab formed on the locking bolt to selectively abut and block the linking device.

2. The lock assembly as claimed in claim 1, wherein the bolt base has a base slot defined longitudinally through the bolt base; and the body further has a guiding rod formed on and protruding from the body and extending slidably into the base slot in the bolt base.

3. The lock assembly as claimed in claim 2, wherein the bolt base of the locking mechanism has a top edge;

a bottom edge; and a guiding tab is formed on the top edge of the bolt base;

the limiting tab is formed on the bottom edge of the bolt base to define a sliding space between the limiting tab and the guiding tab;

the locking bolt is mounted slidably in the sliding space of the bolt base; and the base spring is connected to the guiding tab on the bolt base.

4. The lock assembly as claimed in claim 3, wherein the locking bolt has a bolt slot defined longitudinally through the locking bolt and being parallel with the base slot in the bolt base; and the pushing arm has a first end;

a second end;

a notch defined in the first end of the pushing arm and selectively engaging the pushing lug on the locking cylinder;

a pushing rod formed on and protruding from the second end of the pushing arm and extending slidably into the bolt slot in the locking bolt to push the locking bolt relative to the sliding space in the bolt base when the pushing arm being pivoted.

5. The lock assembly as claimed in claim 4, wherein the body further has a bolt spring mounted in the body and having two ends abutting respectively with the body and the locking bolt.

6. The lock assembly as claimed in claim 5, wherein the connecting device of the latching device comprises a driving cylinder rotatably mounted in the body;

a driving panel mounted around the driving cylinder and having a proximal end mounted around the driving cylinder; and a distal end connected to the linking device;

a connecting arm mounted pivotally in the body, connected slidably to the driving panel via a pivotal rod and the latch, abutting with the driving cylinder and having a proximal end pivotally attached to the body and slidably connected to the driving panel via the pivotal rod; and a distal end connected slidably to the latch; and a latch spring mounted in the body and having two ends abutting respectively with the body and the latch to provide a force to extend the latch out from the body.

7. The lock assembly as claimed in claim 6, wherein the driving cylinder has an outer surface and a driving lug formed on and protruding from the outer surface of the driving cylinder and abutting with the connecting arm;

the driving panel has a mounting hole defined in the proximal end and mounted around the driving cylinder; and the mounting hole in the driving panel has an inner surface and an engaging notch defined in the inner surface and engaging the driving lug on the driving cylinder.

8. The lock assembly as claimed in claim 7, wherein the pivotal rod is formed on and protrudes from the body;

the proximal end of the connecting arm is mounted rotatably around the pivotal rod; and the driving panel further has a curved guiding slot defined through the driving panel and slidably holding the pivotal rod inside the guiding slot.

9. The lock assembly as claimed in claim 8, wherein the body has a top edge;

the locking cylinder and the locking mechanism are mounted near the top edge of the body at a position above the latching device; and the edge on the bolt base abutting with and pushed by the pushing lug on the locking cylinder is the top edge of the bolt base.

10. The lock assembly as claimed in claim 9, wherein the linking device comprises a linking panel mounted slidably in the body, connected to the distal end of the driving panel and having a top edge selectively abutting with the blocking tab on the locking bolt; and two linking arms connected to two ends of the linking panel.

11. The lock assembly as claimed in claim 8, wherein the body has a bottom edge;

the locking cylinder and the locking mechanism are mounted near the bottom edge of the body at a position below the latching device; and the edge on the bolt base abutting with and pushed by the pushing lug on the locking cylinder is the bottom edge of the bolt base.

12. The lock assembly as claimed in claim 11, wherein the linking device comprises a linking panel mounted slidably in the body, connected to the distal end of the driving panel and having a locking notch defined in the linking panel and selectively holding and engaging the blocking tab on the locking bolt; and two linking arms connected to two ends of the linking panel.

13. The lock assembly as claimed in claim 6, wherein the driving cylinder has an outer surface and a driving lug formed on and protruding from the outer surface of the driving cylinder and abutting with the connecting arm;

the driving panel has a mounting hole defined in the proximal end and mounted around the driving cylinder; and the mounting hole in the driving panel has an inner surface and an engaging groove defined in the inner surface and slidably holding the driving lug on the driving cylinder inside the engaging groove.

14. The lock assembly as claimed in claim 13, wherein the body further has a pivotal rod formed on and protruding from the body;

the proximal end of the connecting arm is mounted rotatably around the pivotal rod; and the driving panel further has a curved guiding slot defined through the driving panel and slidably holding the pivotal rod inside the guiding slot.

15. The lock assembly as claimed in claim 14, wherein the body has a top edge; and the locking cylinder and the locking mechanism are mounted near the top edge of the body at a position above the latching device; and the edge on the bolt base abutting with and pushed by the pushing lug on the locking cylinder is the top edge of the bolt base.

16. The lock assembly as claimed in claim 15, wherein the linking device comprises a linking panel mounted slidably in the body, connected to the distal end of the driving panel and having a top edge selectively abutting with the blocking tab on the locking bolt; and two linking arms connected to two ends of the linking panel.

17. The lock assembly as claimed in claim 14, wherein the body has a bottom edge;

the locking cylinder and the locking mechanism are mounted near the bottom edge of the body at a position below the latching device; and the edge on the bolt base abutting with and pushed by the pushing lug on the locking cylinder is the bottom edge of the bolt base.

18. The lock assembly as claimed in claim 17, wherein the linking device comprises a linking panel mounted slidably in the body, connected to the distal end of the driving panel and having a locking notch defined in the linking panel and selectively holding and engaging the blocking tab on the locking bolt; and two linking arms connected to two ends of the linking panel.

19. The lock assembly as claimed in claim 1, wherein the bolt base of the locking mechanism has a top edge;

a bottom edge; and a guiding tab is formed on the top edge of the bolt base;

the limiting tab is formed on the bottom edge of the bolt base to define a sliding space between the limiting tab and the guiding tab;

the locking bolt is mounted slidably in the sliding space of the bolt base; and the base spring is connected to the guiding tab on the bolt base.

20. The lock assembly as claimed in claim 19, wherein the locking bolt has a bolt slot defined longitudinally through the locking bolt; and the pushing arm has a first end;

a second end;

a notch defined in the first end of the pushing arm and selectively engaging the pushing lug on the locking cylinder;

a pushing rod formed on and protruding from the second end of the pushing arm and extending slidably into the bolt slot in the locking bolt to push the locking bolt relative to the sliding space in the bolt base when the pushing arm being pivoted.

* * * * *